United States Patent [19]

Coy

[11] 4,115,996

[45] Sep. 26, 1978

[54] SELF ACTUATING PENDULUM SYSTEM

[76] Inventor: Raymond Walter Coy, 805 Libby Dr., Riverside, Calif. 92507

[21] Appl. No.: 733,187

[22] Filed: Oct. 18, 1976

[51] Int. Cl.[2] ..... G04B 17/02

[52] U.S. Cl. ..... 58/129

[58] Field of Search ..... 58/29–31, 58/129, 130 R, 130 C, 131–133; 74/1.5

[56] References Cited

U.S. PATENT DOCUMENTS

| | | | |
|---|---|---|---|
| 2,995,005 | 8/1961 | Boyles | 58/29 |
| 3,538,756 | 11/1970 | Coombs | 310/81 |
| 3,685,277 | 8/1972 | Fedchenko | 58/30 |

*Primary Examiner*—Edith S. Jackmon

[57] ABSTRACT

The specification details the invention for placing the motive forces within the pendulum system itself, that alternately combine with gravity to produce a predetermined period of oscillation or vibration. The mechanism, attached above the axis, converts the electrical energy, supplied through the bearing, into alternately applied motive force, just sufficient to balance the internal pendulum losses. In some applications, additional force is supplied by this same mechanism to drive mechanically connected vibration registering gear assemblies.

1 Claim, 7 Drawing Figures

TOP VIEW

SELF ACTUATING PENDULUM SYSTEM

The object of this invention is to provide a pendulum system suitable for regulating time indicating devices that is virtually maintenance free, with an accuracy equivalent to the electric clock, for home use. To achieve that, a sychronous 60 Hz motor geared to counter-rotating eccentric weights is fixed to the pendulum above the axis of rotation. The rotation of the eccentric weights is syncronized to the natural frequency of the pendulum. (i.e. a pendulum that oscillates 12 cycles per minute has eccentric weights that rotate at 12 R.P.M. in a plane perpendicular to the vertical line of the pendulum.) These rotating weights, combined with the action of gravity, counteract the normal losses within the pendulum system that tend to return it to rest and maintain the desired period of oscillation. Additionally, this system of adding increments of torque to the pendulum at appropriate points in the cycle will accommodate to slight imbalances or out of phase condition between the natural frequency and the R.P.M. of the eccentric weights: i.e. something less than 1%.

DETAILED DESCRIPTION

This pendulum system is unique in that all the mechanical motive forces to maintain the pendulum in motion are contained within the pendulum system. In addition, enough force is available to not only provide timing increments for the time indicating system (clock) but to also drive the time indicating mechanism when appropriate.

Figure 7:
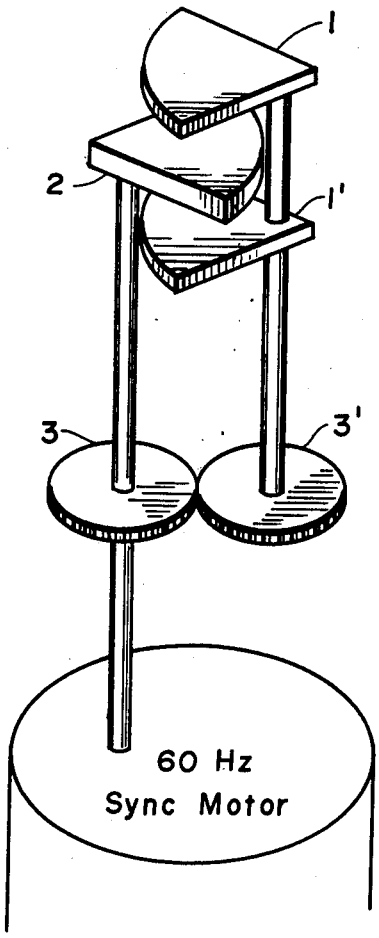
FIG. 7 shows in more detail the method of achieving an effective common plane of rotation for the three weights and how they interleave during rotation.

The pendulum has a partially counterbalancing mass above the axis of rotation resulting in a 5 second period of oscillation. (of course any period of vibration could be established by proper selection and placement of the partially counterbalancing mass). The pendulum is actuated by a 60 Hz geared synchronous motor with a 12 R.P.M. output shaft. Mounted on this shaft is one half of the counter rotating mass and geared to this shaft is the other half, split into equal parts and separated by a clearance that will allow the first half to pass between the half separated into equal portions. (See FIG. 7.) This provides a common plane of rotation for the effective center of gravity of the counter rotating masses, resulting in uniform application of force in the plane of pendulum movement. Note that FIG. 7 is rotated 90° about the pendulum vertical axis for clarity.

The geared sync motor with the counter rotating eccentric masses is mounted above the pendulum axis of rotation and forms part of the partially counterbalancing mass.

The pendulum is supported on two electrically insulated class 6 ball bearings. Through these two bearings 115V 60Hz is supplied to the sync motor.

Figure 1:
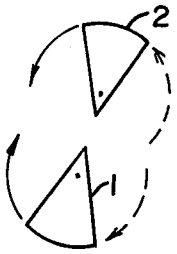
FIGS. 1–3 show views of the rotating weights which indicate the positional relationship of the weights to the pendulum at given points in the cycle.
Figure 2:
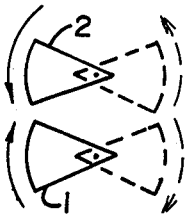
Figure 3:
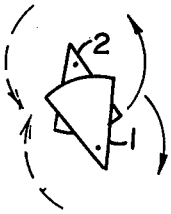
Figure 4:
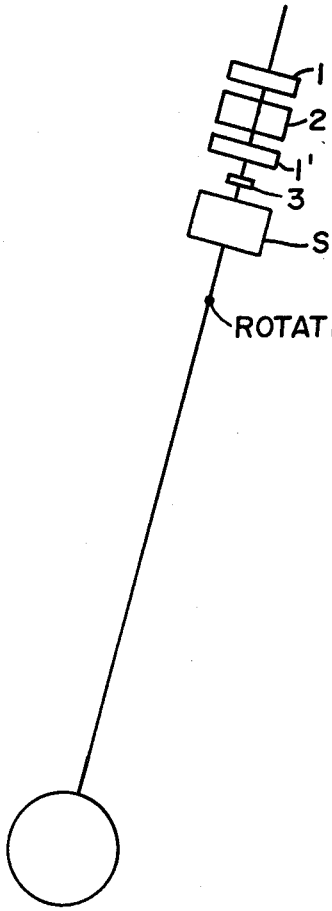
FIGS. 4–6 show three inclinations of the pendulum to the gravity vector.
Figure 5:
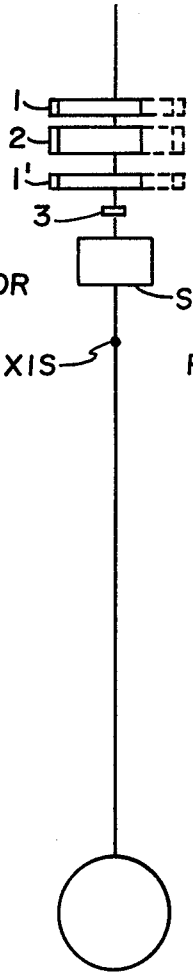
Figure 6:
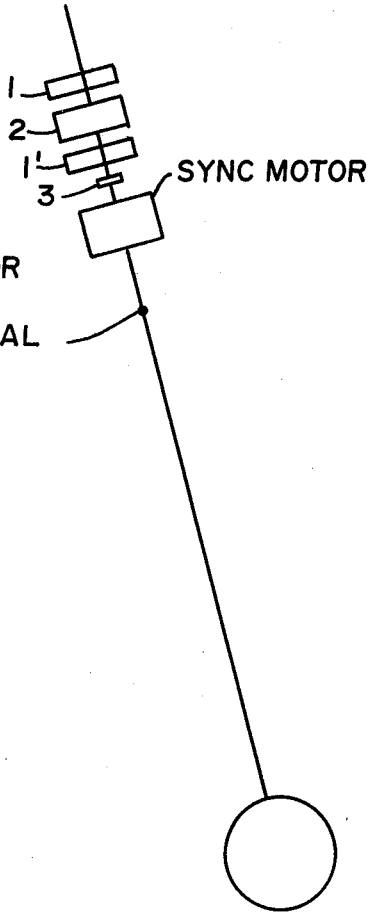

With a pendulum balanced for 5 second period (12 cycles per minute) and the 12 R.P.M. output sync motor connected, the pendulum bob as shown in FIG. 5, starts to move toward FIG. 6 with the eccentric mass rotating as indicated, top view. Rotating eccentric mass refers to those elements numbered 1, 2 and 1′ in FIG. 7 hereafter simply called weights. As the weights approach the relationship shown in FIG. 6, gravity is decelerating the pendulum and has balanced out the reactive force applied to the top of the pendulum by the weights. At the position shown in FIG. 6, the gravitational force tending to return the pendulum to the vertical is maximum. At the same moment, the reactive force supplied by the weights whose relationship to the pendulum is shown in FIG. 3 is also maximum but opposed and just balanced by gravitational force on the pendulum. As the pendulum starts its return swing, the reactive force of the weights, with respect to the pendulum plane, starts to decrease and is zero at the moment the pendulum passes through the vertical, FIG. 5. At this same instant the weights have reached the maximum off-center position as shown in FIG. 2 and lever the pendulum toward position shown in FIG. 4; also, the weights now rotating outward away from the pendulum plane as shown in FIG. 1 are increasing in applied reactive force that drives the pendulum to the extremity of its arc. The forces applied by the rotating weights combine with gravity to provide a smooth application of torque completely independent of any mechanical forces external to the pendulum system.

The pendulum is a self starting mechanism with an ever increasing arc until the point is reached where the combined gravitation force and pendulum equal the forces supplied by the rotating weights. At that point the arc stabalizes and the pendulum becomes an accurate time measuring device. During the start up phase, the phased relationship between the position of the weights and the pendulum rod inclination are not exactly as shown on the schematic due to a slight difference in time increment for the varying arc lengths as the pendulum accelerates to a stable arc. This pendulum system demostrates a surprising ability to accomodate to this slightly out of phase condition. The pendulum will continue to operate provided departure from the ideal phased relationship shown in the schematic is somewhat less than 90°. However, that point can be reached by a comparatively small change in weight distribution.

Notice that as the pendulum moves from the vertical, the plane of the rotating weights is inclined to the horizontal. With the natural frequency of the pendulum matched to the sync motor output, the weights are always being driven slightly "uphill" except when passing through zero inclination. This maintains a back pressure on the gearing, eliminating all "gear backlash".

EMPIRICAL

A pendulum was constructed with one meter radius (axis to bob) and 30 c.m. radius (axis to top of rotating weights). Sufficient mass was provided in the rotating weights to establish a stable arc of 75 c.m. To determine how well the pendulum would operate with small changes in weight distribution, 0.2 of 1% of the total pendulum weight was removed from the bob. Power was supplied to the sync motor with the pendulum now achieving a much reduced arc. In this configuration, the arc fluctuated between 10 and 12 c.m. However, the average of these arcs proved to be uniform and the relationship of rotating weights to the natural frequency of the pendulum never fell completely out of sync.

Then 0.4 of 1% of the total pendulum weight was removed from the bob. In this configuration, the pendulum failed to achieve a stable are, vibrated around a 2 c.m. arc with the rotating weights and natural frequency of the pendulum continuously in and out of sync. Note that these measurements were obtained to the accuracy achievable in the average home workshop. Hence the observation that it will operate satisfactorily at something less than 1% out of balance relationship seems reasonable. The center of gravity for the 12 cycles per minute partially counterbalanced pendulum is approximately 1.25 c.m. below the axis of rotation.

I claim

1. A selfstarting, self actuating pendulum that accelerates from stand-still to a stable arc length employing a 60 Hz synchronous motor, geared to counter rotating eccentric weights which form an integral part of a partially counter balancing weight and fixed to the pendulum rod above the pendulum axis of rotation which weights rotate in a plane perpendicular to the center line of the pendulum and apply a sinusoidal thrust to the pendulum and when combined with the action of gravity overcome the pendulum losses and maintain predetermined, continuous and regular pendulum oscillation.

* * * * *